United States Patent [19]

Ristovski

[11] 4,326,763

[45] Apr. 27, 1982

[54] ELECTRICAL PLUG

[75] Inventor: Ilija Ristovski, Kuppenheim, Fed. Rep. of Germany

[73] Assignee: Djoko Ristovski, Kuppenheim, Fed. Rep. of Germany

[21] Appl. No.: 110,292

[22] Filed: Jan. 8, 1980

[30] Foreign Application Priority Data

Jan. 8, 1979 [DE] Fed. Rep. of Germany ..... 2900491

[51] Int. Cl.[3] ..... H01R 13/62

[52] U.S. Cl. ..... 339/14 P; 339/45 R

[58] Field of Search ..... 339/45, 46, 14

[56] References Cited

U.S. PATENT DOCUMENTS

| | | | |
|---|---|---|---|
| 2,394,618 | 2/1946 | Kunasch | 339/45 R |
| 2,427,390 | 9/1947 | Dear | 339/45 R |
| 2,571,046 | 10/1951 | Maisey | 339/45 R |

FOREIGN PATENT DOCUMENTS

| | | | |
|---|---|---|---|
| 1590714 | 6/1970 | Fed. Rep. of Germany | 339/46 |
| 281366 | 11/1927 | United Kingdom | 339/46 |
| 663920 | 12/1951 | United Kingdom | 339/45 R |

*Primary Examiner*—Joseph H. McGlynn

*Attorney, Agent, or Firm*—Allison C. Collard; Thomas M. Galgano

[57] ABSTRACT

An electrical plug includes a housing made of insulating material for receiving plug contacts, in particular, plug pins and coupling means for a feeder cable. The housing has a front face and a retractable spring-loaded release device received in the housing for movement between a retracted position, in which it is disposed substantially within the housing, and a withdrawn position, in which it projects outwardly from its front face. An actuation device is mounted on the housing for triggering movement of the spring-loaded device to said withdrawn position thereof by spring force, so that when the plug is received within a wall socket or a coupling having a mounting face opposing the front face thereof, the release device upon actuation will engage and push off from the mounting face to automatically effect or at least facilitate plug release.

3 Claims, 8 Drawing Figures

ELECTRICAL PLUG

The present invention relates to an electrical plug. More particularly, it relates to an electrical plug consisting of a housing or jacket which is made of an insulating material and which receives the plug contacts and, in particular, the plug pins and the coupling means for the feeder cable.

Various types of such plugs are known, especially the so-called "protective contact" plugs which have the disadvantage that, although they can be easily plugged into the wall socket or the electrical coupling with one hand, they are often very difficult to pull out or withdraw from the wall outlet or the coupling. In particular, when the plug is to be pulled out from a multiple-coupling which is loosely mounted on a mounting face, the coupling must be held with one's free hand, so as to permit a separation of the coupling and plug. Also, with many different types of wall outlets, to pull out the plug therefrom is relatively difficult and requires a lot of force.

It is therefore an object of the invention to eliminate this disadvantage of the known electrical plugs and to provide a plug which can be easily pulled out from a wall socket or a coupling, or with which such a pulling out of the plug is facilitated.

This object is achieved in accordance with the present invention by the provision of an electrical plug of the aforementioned type which is characterized in that a retractable, spring-biased release device is provided in the front face of the plug. This device is triggered by an actuating device disposed on the housing or the jacket, so as to move the release device outwardly from the front face of the plug under spring force, and to automatically effect or facilitate the removal of the plug by pushing off from the counter wall or face of the wall socket or the coupling.

With the electrical plug in accordance with the invention, a significant advantage is obtained—namely, that the plug may be pulled out without using any force and very frequently may be pulled from the wall socket or the coupling using only one hand. A further particular advantage is that the insertion of the plug into the wall outlet or coupling is practically unimpaired.

In accordance with a particular embodiment of the invention, the plug is so constructed that a bolt or pin is disposed in a central recess of the plug which is provided with an offset flange abutment for a helical spring which engages with its other end against a rigid abutment within the housing so as to effect spring-loading of the bolt. A further rounded abutment is provided on the other end of the bolt which cooperates in a detachable or releasable manner with an actuating device in such a way that, when pressing a button of the actuating device, the bolt is pushed outwardly through the front face of the plug by the force of the spring so as to detach or release the plug from the wall socket or the coupling.

The other end of the bolt which is disposed within the plug cooperates with an actuating device which, for example, may include a push button mounted at a convenient gripping position on the outside of the plug and which permits, during the releasing operation, the bolt to be pushed outwardly through the front face of the plug up to a point which is limited by an inside abutment in the plug.

The actuating device may consist of a small plate having a window opening which is disposed transversely in the plug and is movable in a longitudinal direction (i.e., transversely relative to the plug). The plate can be actuated by a button which is mounted on the exterior of the plug and is spring-loaded by a further spring. As a result, when inserting the bolt through the opening in the small plate, the plate is retracted by the spring force and retains the bolt in this retracted position. This can be carried out simultaneously while inserting the plug into a coupling or the wall outlet. For triggering release, only the actuating button has to be depressed, so that the bolt is released within the housing and is rapidly pushed outwardly from the front face of the plug by the spring. This automatically releases the connection between the plug and the wall outlet or the coupling, or at least facilitates this decoupling action.

Other objects and features of the present invention will become apparent from the following detailed description, considered in connection with the accompanying drawing, which discloses a single embodiment of the invention. It is to be understood, however, that the drawing is designed for the purpose of illustration only, and not as a definition of the limits of the invention.

In the drawing, wherein similar reference characters denote similar elements throughout the several views.

Figures 1, 2, 3, 4, 5, 6:
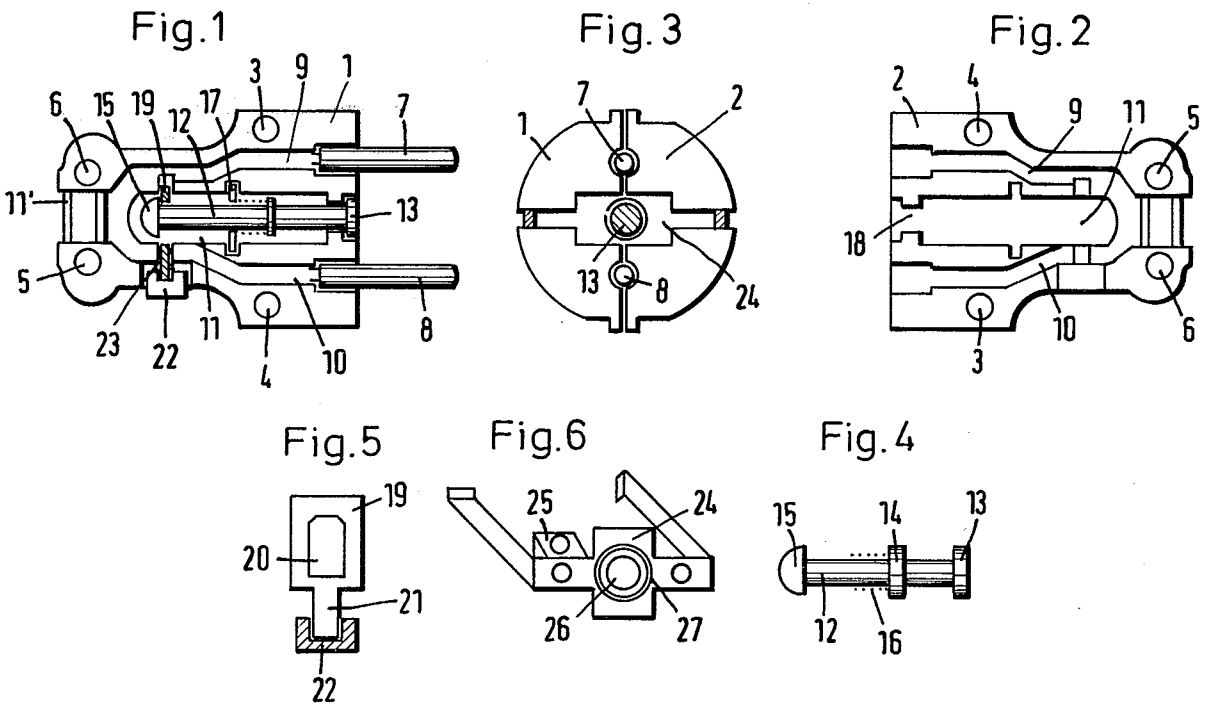
FIG. 1 is a plan view of one half of an opened plug housing of a plug embodying the present invention, showing the plug pins and the retractable pull out device received therein.
FIG. 2 is a plan view of the other half of the plug housing, which is screwed to the other half of the plug housing shown in FIG. 1 and is provided with corresponding recesses.
FIG. 3 is an end view of the front face of the plug embodying the present invention.
Figure 3A:
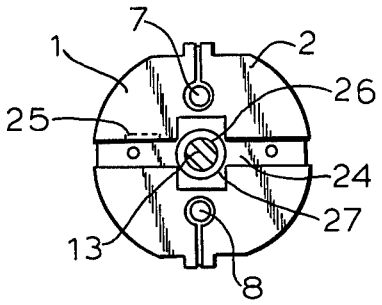

FIG. 3*a* is an end view comparable to that of FIG. 3, but showing the round contact of FIG. 6 mounted on the front face thereof.

Figure 5A:
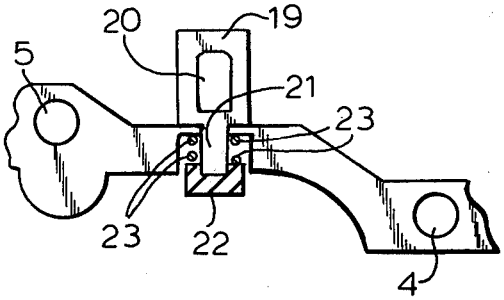

FIG. 4 is a side elevational view of the bolt of the retractable pull out device shown in FIG. 1;

FIG. 5 is a side elevational view, in part section, of the actuating device for relesing the bolt shown in FIG. 4;

FIG. 5*a* is an enlarged fragmentarily-illustrated side elevational view, in part section, of the plug housing and plug actuating device shown in FIGS. 1 and 5, respectively, and FIG. 6 is a perspective view of the ground contact for the plug in accordance with the invention.

As can be seen from the drawing, a plug embodying the invention is illustrated which consists of two shell halves 1 and 2 which each have, for example, a pin 3 and a bore or hole 4 and a corresponding pin 5 and bore 6 which cooperate with one another and which serve to align the plug halves during assembly. It may also be possible to provide suitable bores at the rear end of the plug, so as to provide screw means for mounting the feeder cable. The mounting of the two shell halves 1 and 2 may be carried out in a known manner with screw or other locking means.

The two pins 7 and 8 are inserted into shell half 1 of FIG. 1 and each terminate in conduits 9 and 10, respectively, for the feeder cable which is to be introduced at 11'.

FIG. 2 illustrates the corresponding recesses 9 and 10 for the cable introduction. The plug in accordance with the invention is provided with a device for automatic or facilitated detachment of the plug from the wall socket, or coupling, respectively. The device includes a pin or bolt 12 which is inserted in a suitably shaped central bore 11, and which has a flange at one end serving as a front offset face 13, a center flange abutment 14 and a rear rounded abutment 15 at its opposite end. A helical spring 16 is mounted on bolt 12 such that it is disposed under tension between center abutment 14 and a corresponding abutment 17 which is mounted in bore 11 of the housing shell halves 1 and 2, and through which abutment, bolt 12 passes.

A profiled recess 18 is provided on the front face of the plug which is so dimensioned relative to bolt 12 that the front face 13 of bolt 12 disappears completely in the plug when the bolt is in its retracted position, thus forming a flush plane with the front face of the plug. The rear end of recess 18 is so shaped that it forms an abutment support for abutment 14, so that bolt 12 cannot be entirely withdrawn from the plug when it is pushed outwardly.

An actuating device is provided for actuating bolt 12. The device consists of a plate 19 (see FIG. 5) having a window opening 20 which is reciprocally moved in the housing by means of a lateral lug 21. A push button 22 is mounted on lug 21 which operates against the force of a spring 23, which serves to bias the button in an outward direction.

A profile-like ground contact 24 is provided which runs transversely with respect to the two shell halves 1 and 2, so that a screw connection 25 with the ground contact is provided. The ground contact is provided with a central bore 26 through which bolt 12 extends. Bore 26 is provided with an insulating ring 27, so that bolt 12 is insulated with respect to the ground contact.

The operation of the plug in accordance with the invention is as follows:

When inserting the plug into a wall socket or coupling, bolt 12 is pushed through the front face of the plug into the plug housing against the biasing force of spring 16 until abutment 15 has penetrated opening 20 of plate 19. As a result, the plate 19 which is biased in an outward direction by spring 23 engages behind abutment 15. During the desired withdrawal of the plug from the wall socket or the coupling, button 22 is depressed into housing 1, 2, thus releasing bolt 12 which is then forced outwardly in a rapid manner from the front face of the plug by spring 16. Consequently, a release or withdrawal movement of the plug from the wall socket or from the coupling occurs, with head 13 supporting itself against the face of the wall outlet or the coupling opposing the front face of the plug. At a sufficient spring force, this can be carried out automatically or with additional manual movement the plug may be pulled from the coupling or the plug in an easy and facile manner. The outward movement of bolt 12 is limited by the abutment 14 which engages against the inside of the profiled opening 18. By a renewed pushing, bolt 12 is again pushed back into the plug until it engages opening 20 of plate 19.

Naturally, the device embodying the present invention is not limited to a plug made of two shell halves, as described with the illustrated embodiment. This inventive device may be used in many different plug types, for example, completely encased plugs, or in couplings which are mounted onto pins which extend from a further coupling, or into a rigidly installed plug.

Thus, while only a single embodiment of the present invention has been shown and described, it will be obvious that many modifications and changes may be made thereunto, without departing from the spirit and scope of the invention.

What is claimed is:

1. In an electrical plug of the type including a housing made of insulating material for receiving plug contacts and coupling means for a feeder cable, the improvement comprising:

said housing having a front end portion having a front face, a central bore formed therein disposed normally to and opening into said front face thereof, a rigid abutment extending radially into said central bore, a rear end portion having a cable bore for said feeder cable which is disposed in axial alignment with said central bore and a pair of feeder cable conduits formed therein disposed on opposite sides of said central bore, spaced therefrom, which merge with said cable bore in said rear end portion and open onto said front face of said front end portion;

a retractable spring-loaded release device received in said housing for movement between a retracted position, in which it is disposed substantially within said housing, and a withdrawn position, in which is projects outwardly fro said front face, said spring-loaded release device comprising a bolt disposed at least partially within said central bore having a flange which serves as an offset abutment and a rounded abutment disposed at one end thereof, said bolt being positioned in said bore such that said flange thereof is disposed in front of said rigid abutment, and a helical spring received on said bolt which is biased between said rigid abutment of said housing and said flange of said bolt so as to urge said bolt in a direction towards said withdrawn position thereof; and an actuation device mounted on said housing for triggering movement of said spring-loaded release device to said withdrawn position thereof by spring force, so that when said plug is received within a wall socket or a coupling having a mounting face opposing said front face thereof, said release device upon actuation will engage and push off from said mounting face to automatically effect or at least facilitate plug release, said actuation device being releasably coupled to said rounded abutment of said bolt and including an actuation button which, when depressed, effects release of said rounded abutment of said bolt, so as to permit said bolt to move to said withdrawn position thereof under the force of said spring so as to facilitate plug release, said actuation device also comprising a plate having an opening formed therethough which is mounted for which is mounted for reciprocal movement in said bore for movement between a locking position in which said rounded abutment of said bolt is retained in engagement with said plate opening and a release position in which said rounded abutment is released from said opening, said plate being attached to a lug extending outwardly of said housing on which said button is secured, said button being spring-loaded so as to urge the same outwardly and so as to normally maintain said plate in a locking position, and so that, upon depression of said button, said plate is moved to said release position thereof under spring tension.

2. The electrical plug according to claim 1, wherein said bolt has an outer end provided with a flat head which, when said bolt is in its retracted position, lies flush with said front face of said housing.

3. The electrical plug according to claims 1 or 2, additionally including a ground contact mounted on said housing having a bore in the center thereof through which said bolt extends, said bore being lined with an insulating ring.

* * * * *